United States Patent [19]

Rezanka

[11] 4,108,546

[45] Aug. 22, 1978

[54] CLEANING APPARATUS AND ELECTROSTATOGRAPHIC REPRODUCING MACHINE

[75] Inventor: Ivan Rezanka, Pittsford, N.Y.

[73] Assignee: Xerox Corporation, Stamford, Conn.

[21] Appl. No.: 737,303

[22] Filed: Nov. 1, 1976

[51] Int. Cl.[2] ..... G03G 21/00

[52] U.S. Cl. ..... 355/15; 15/256.51; 118/652; 209/223 R

[58] Field of Search ..... 355/3 R, 15; 118/652, 118/657; 209/223 R, 223 A; 15/256.51

[56] References Cited

U.S. PATENT DOCUMENTS

| | | | |
|---|---|---|---|
| 3,834,804 | 9/1974 | Bhagat et al. | 355/15 X |
| 3,993,022 | 11/1976 | Zimmer | 118/652 |
| 3,997,688 | 12/1976 | Gundlach et al. | 355/3 DD X |
| 4,006,987 | 2/1977 | Tomono et al. | 355/15 |

FOREIGN PATENT DOCUMENTS

| | | | |
|---|---|---|---|
| 2,453,643 | 5/1975 | Fed. Rep. of Germany | 355/15 |

*Primary Examiner*—Fred L. Braun

[57] ABSTRACT

A cleaning apparatus for use in an electrostatographic reproducing machine and an electrostatographic reproducing machine utilize magnetic attraction to aid in removing magnetic toner from an imaging surface or cleaning device. The cleaning apparatus comprises a prolate magnet having at least one pole adjacent the surface to be cleaned so that a gap of from about 0.005 to about 0.050 inches is defined. The ratio of the longitudinal width of the magnetic pole to the gap between the magnetic pole and the surface to be cleaned is maintained within the range of from about 0.5 to about 2.

26 Claims, 5 Drawing Figures

CLEANING APPARATUS AND ELECTROSTATOGRAPHIC REPRODUCING MACHINE

BACKGROUND OF THE INVENTION

This invention relates to a cleaning apparatus for use in an electrostatographic reproducing machine. The cleaning apparatus is particularly adapted for removing magnetic particles from an imaging surface in order to clean the surface. Alternatively the cleaning apparatus can be used to remove magnetic particles from a conventional cleaning device which in turn removes the particles from the imaging surface.

The use of magnetic toner particles for developing electrostatic images is well known in the art. For example, U.S. Pat. No. 2,846,333 to Wilson teaches the use of a single component magnetic developer material which is applied directly to a photoconductive surface for development. U.S. Pat. No. 3,909,258 to Kotz also discloses the use of a single component developer for developing electrostatic images. The magnetic toner particles may be conductive or non-conductive.

Conventional cleaning devices known in the art comprise brushes, webs, rollers, blades, etc., as exemplified by the following U.S. Pat. Nos. 3,655,373 to Fisher; 3,099,856 to Eichorn et al.; 3,807,853 to Hudson; and 3,634,072 to Sullivan.

Various reverse development approaches to cleaning are known which include the use of magnetic brush cleaning as exemplified in the following U.S. Pat. Nos. 2,956,487 to Giamo and 3,580,673 to Yang.

Of particular interest with respect to the present invention is U.S. Pat. No. 3,659,311 to Waren which discloses a device for scavenging magnetizable powder from a drum in a printing apparatus. The powder is attracted from the drum to the surface of a non-magnetic tube positioned parallel to the drum. A rotatable set of adjacent magnets is contained within the tube. The rotation of the magnets causes a divergent magnetic flux field to attract the magnetizable powder and to work the powder around the surface of the tube in a direction opposite to the magnet rotation and onto a ledge extention of the tube surface so that it may fall into a collection trough.

While it is known to employ magnetizable or magnetic toner particles for developing electrostatic images in electrostatic reproducing machines the fullest advantage has not been taken of the magnetizable nature of the particles to aid in their removal from an imaging surface or the cleaning device used for such removal.

SUMMARY OF THE INVENTION

In accordance with this invention a cleaning apparatus is provided for an electrostatographic reproducing machine as well as an electrostatographic reproducing machine employing the apparatus.

In one embodiment the apparatus comprises a magnetic cleaning apparatus arranged adjacent a moving imaging surface. The magnetic cleaning apparatus includes a moving support surface for receiving toner material removed from the imaging surface and for transporting it away. A magnetic cleaning member has at least one magnetic pole positioned in close proximity to the imaging surface with the support surface interposed therebetween. The gap between the at least one magnetic pole and the imaging surface is maintained within about 0.005 to about 0.050 inches and preferably from about 0.005 to about 0.015 inches. The magnetic member extends across the imaging surface. The ratio of the width of the magnetic pole adjacent the imaging surface to the gap from the magnetic pole to the imaging surface is maintained in the range of from about 0.3 to about 2, and preferably from about 0.5 to about 1.

The use of such a shaped magnet pole closely adjacent to the imaging surface serves to maximize both the magnetization of the magnetic particles to be removed and the field gradient of the magnetic pole thereby providing increased force on the toner particles. This substantially aids in the removal of those particles from the imaging surface or cleaning device.

In accordance with an alternative embodiment of the invention a conventional toner cleaning system such as a brush cleaner, web cleaner, roller cleaner, blade cleaner, or other desired cleaner is employed and a magnetic cleaning system as described above is utilized to extract or transport the magnetic toner particles away from the conventional cleaning device.

In a particularly preferred embodiment the magnetic member has the shape of an eliptical cylinder.

Accordingly, it is an object of this invention to provide an improved cleaning apparatus for an electrostatographic reproducing machine and a machine employing such an apparatus.

It is a further object of this invention to provide an apparatus as above for magnetically removing particles from an imaging surface.

It is a still further object of this invention to provide an apparatus as above for magnetically removing particles from a cleaning device.

These and other objects will become more apparent from the following description and drawings.

DETAILED DESCRIPTION OF THE PREFERRED EMBODIMENTS

Figure 1:
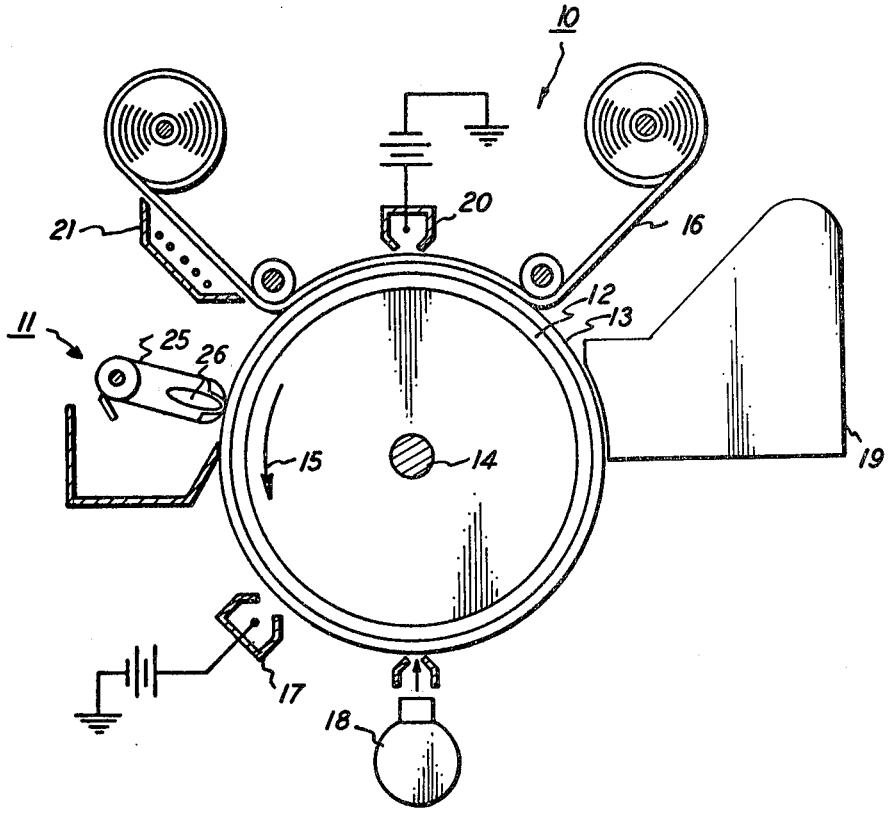
FIG. 1 is a schematic representation of a reproducing apparatus in accordance with the present invention.

Referring now to FIG. 1 there is shown by way of example an automatic xerographic reproducing machine 10 which incorporates the cleaning apparatus 11 of the present invention. The reproducing machine 10 depicted in FIG. 1 illustrates the various components utilized therein for producing copies from an original document. Although the cleaning apparatus 11 of the present invention is particularly well adapted for use in an automatic xerographic reproducing machine 10, it should become evident from the following description that it is equally well suited for use in a wide variety of electrostatographic systems and it is not necessarily limited in its application to the particular embodiment or embodiments shown herein.

Figure 2:
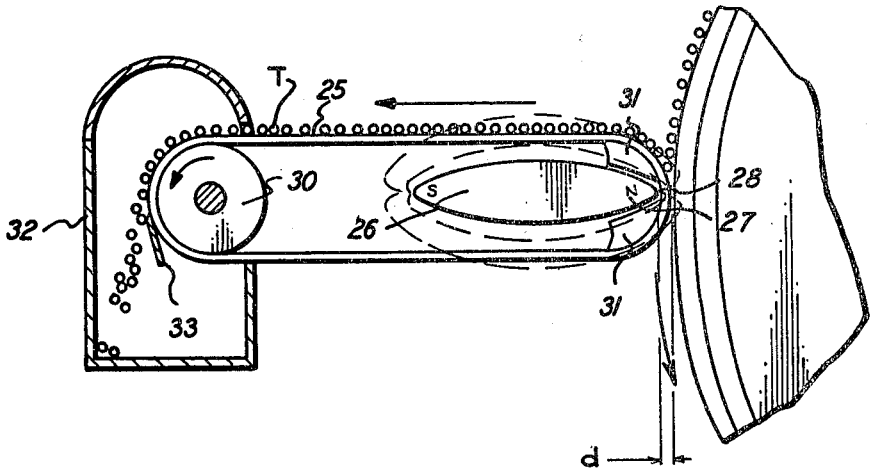
FIG. 2 is a schematic representation of a cleaning apparatus of this invention employed for cleaning an imaging surface.

The reproducing machine 10 illustrated in FIG. 2 employs an image recording drum-like member 12, the outer periphery of which is coated with a suitable photoconductive material 13. Alternatively, plate or web or belt-type recording members could be employed. One type of suitable photoconductive material is disclosed in U.S. Pat. No. 2,970,906, issued to Bixby. The drum 12 is suitably journaled for rotation within a machine frame (not shown) by means of shaft 14 and rotates in the direction indicated by arrow 15 to bring the image-bearing surface 13 thereon past a plurality of xerographic processing stations. Suitable drive means (not shown) are provided to power and coordinate the motion of the various cooperating machine components whereby a faithful reproducing of the original input scene information is recorded upon a web or sheet of final support material 16 such as paper or the like.

The practice of xerography is well known in the art and is the subject of numerous patents and texts including *Electrophotography* by Schaffert, published in 1965, and *Xerography and Related Processes* by Dessauer and Clark, published in 1965.

Initially, the drum 12 moves the photoconductive surface 13 through a charging station 17. At the charging station, an electrostatic charge is placed uniformly over the photoconductive surface 13 preparatory to imaging. The charging may be provided by a corona generating device of the type described in U.S. Pat. No. 2,836,725, issued to Vyverberg.

Thereafter, the drum 12 is rotated to exposure station 18 wherein the charged photoconductive surface 13 is exposed to a light image of the original input scene information whereby the charge is selectively dissipated in the light exposed regions to record the original input scene in the form of a latent electrostatic image. A suitable exposure system may be of a type described in U.S. Pat. No. 3,062,110, issued to Shepardson et al.. After exposure, drum 12 rotates the electrostatic latent image recorded on the photoconductive surface 13 to development station 19. Development station 19 includes a supply of single component magnetic developer material for rendering the latent image visible as a toner defined image. Preferably, developer unit 19 is a magnetic brush development system as in the above-noted Wilson or Kotz patents. In such a system, the single component magnetic developer material is brought through a directional flux field forming a brush thereof. The brush of magnetic developer material contacts the surface 13. The latent image attracts electrostatically the single component magnetic developer material from the system 19.

The developed image on the photoconductive surface 13 is then brought into contact with web 16 of final support material within a transfer station 20 and the toner image is transferred from the photoconductive surface 13 to the contacting side of the web 16. The final support material may be paper, plastic, etc., as desired.

After the toner image has been transferred to the final support material 16, the web with the image thereon is advanced to a suitable fuser 21 which coalesces the transferred powder image thereto. One type of suitable fuser is described in U.S. Pat. No. 2,701,765, issued to Codichini et al.. After the fusing process the web 16 is advanced to a suitable output device.

Although a preponderance of the toner powder is transferred to the final support material 16, invariably some residual toner remains on the photoconductive surface 13 after the transfer of the toner powder image to the final support material. The residual toner particles remaining on the photoconductive surface 13 after the transfer operation are removed therefrom as the drum moves through the cleaning station 11. The toner particles are cleaned from the photoconductive surface 13 by the use of a magnetic cleaning system as will be set forth in greater detail hereafter.

It is believed that the foregoing description is sufficient for purposes of the present application to illustrate the general operation of an automatic xerographic copier 10 which can embody the cleaning apparatus 11 in accordance with the present invention.

The cleaning station 11 is positioned downstream from the transfer station 20 and upstream of the charging station 17. If desired, the removed toner can be returned for reuse to the developer station 19 by a suitable conveyor system.

Referring now to FIG. 2, a cleaning apparatus 11 in accordance with the present invention will be described in greater detail. The cleaning apparatus of the embodiment of FIG. 2 is arranged to clean a desired imaging surface 13 which may be photoconductive or photosensitive as desired. Residual magnetic toner particles T which remain on the surface 13 after image transfer as described above are removed by the cleaning apparatus 11. A transport and support surface 25 is arranged to receive and carry away the toner particles removed from the imaging surface 13. The support surface 25 which is shown comprises the surface of a belt. The belt 25 should be formed of a non-magnetic material so as not to interfere with or shunt the magnetic fields generated by the cleaning magnet. Preferably, the belt is non-conductive so as to reduce or eliminate the occurrence of eddy currents. A suitable material for the belt would be various organic compounds such as Mylar or other polyester films. Alternatively, a cylinder or any desired support surface shape could be employed.

Supported internally of the belt 25 is a magnetic cleaning member 26 in accordance with the present invention. It is proposed to clean the untransferred magnetic toner from the surface 13 of the photoreceptor by establishing an inhomogeneous magnetic field across the axial width of the photoreceptor. This is accomplished by positioning at least one cleaning magnetic pole 27 in close proximity to the photoreceptor surface 13. At least part of the magnetic cleaning member 26 is formed from a magnetic material and is permanently magnetized.

The magnet configuration 26 which will be described hereafter is selected so as to provide magnetic fields close to the intrinsic fields of the permanent magnet and fields which are strongly inhomogeneous at the imaging surface 13. This is accomplished in accordance with the present invention by shaping at least one magnetic pole 27 hereafter referred to as the cleaning magnetic pole 26 in a predetermined way.

While only one cleaning magnetic pole is shown, if desired, dipole, tripole or quadrapole cleaning configurations could be employed. A dipole configuration would have a conventional C-shape and a tripole, for example, would have a conventional E-shape. The shape of the poles adjacent the surface 13, however, would be maintained in accordance with the shape of the single cleaning pole approach shown in FIG. 2.

When a magnetic particle is placed in an inhomogeneous magnetic field, such that the distance over which the field substantially varies is large compared to the dimensions of the particle, the magnetic force exerted on the particle is proportional to the gradient of the magnetic field. If the particle is either magnetically soft or has not been magnetized before turning on the field then the force is also proportional to the magnitude of the field itself up to the saturation region. In the implementation of magnetic fields a combination of ferromagnetic material and demagnetization effects play an important role and limit the value of the magnetic field which can be achieved outside the ferromagnetic objects. This effect has been found to be shape dependent. Generally oblate configurations provide the weakest fields while prolate configurations or elongated magnets provide the best or strongest fields, where the direction in which shape is probed is the direction of the magnetization.

It has been found in accordance with this invention that to best utilize the intrinsic properties of magnetic materials the selected configuration should be prolate. In accordance with the embodiment of FIG. 2, an elongated magnetic cleaning member 26 is positioned generally normal to the direction of relative motion between the photoreceptor surface 11 and the cleaning support surface 25. In a particularly preferred embodiment as shown, the cross-section of the magnetic cleaning member 26 comprises an eliptical cylinder magnetized as indicated in FIG. 2. In this embodiment for an Alnico magnet material, it can be shown that the major axis of the eliptical cross-section should be about 10 or more times larger than the minor axis in order to reduce demagnitization effects.

It has been found in accordance with this invention that the radius of curvature of the cleaning magnetic pole 27 is extremely important to achieve the maximization of induced magnetization in the toner particles and of the field gradient. The radius of curvature is governed by the distance "*d*" between the edge 28 of the cleaning magnetic pole 27 of the magnetic member 26 and the photoreceptor surface 13.

It has been found in accordance with this invention that the ratio of the longitudinal width cleaning pole edge 28 or twice the radius of curvature for the embodiment of FIG. 2 to the gap from the imaging surface 13 to the cleaning pole 28 should be from about 0.3 to about 2, and preferably from about 0.5 to about 1. The gap "*d*" between the imaging surface 13 and the cleaning pole edge 28 should be from about 0.005 to about 0.050 inches and preferably from about 0.005 to about 0.015 inches.

In the magnet 26 which is shown an eliptical cross-section has been employed which comprises an optimum design. It is recognized, however, that a magnet having an elongated rectangular configuration or other desired prolate configurations could be employed to approximate the eliptical configuration shown. In such a case the longitudinal width of the cleaning pole edge 28 of the magnet should be maintained within the aforenoted ratios. The longitudinal width of the edge 28 of the cleaning magnet 26 in accordance with this invention comprises the width of the magnet in the direction of relative movement between the imaging surface 13 and the support surface 25.

The transverse width of the cleaning magnet, which is measured axially across the imaging surface should be sufficient to extend completely across that surface. The length of the cleaning magnet 26 is measured in the direction normal to the imaging surface 13 and as noted above should preferably be for an Alnico magnet at least about 10 times the longitudinal width of the cleaning pole edge 28. For other materials having greater magnetic field strengths, lesser ratios of longitudinal width to normal length can be employed.

The support surface associated with the magnetic cleaning magnet 26, as shown in FIG. 2, comprises a belt which is arranged about a pulley 30 at one end and cooperating guide elements 31 at the other end. The guide elements 31 are formed of a non-magnetic material so that they do not act to reduce or short circuit the magnetic fields associated with the magnetic cleaning member 26. The end of the belt associated with the pulley 30 is arranged in communication with a toner sump 32 for receiving the particles removed by the cleaning system. A blade 33 engages the belt to remove any toner particles T from the belt so that they may drop into the sump.

The magnet arrangement 26 serves to retain the particles T on the belt in the region of the imaging surface 13 with the magnetic field decreasing as the particles are carried further away from the magnet. Therefore, when they engage the blade they are no longer significantly acted upon by the magnetic field and can fall under the action of gravity into the sump.

Figure 3:
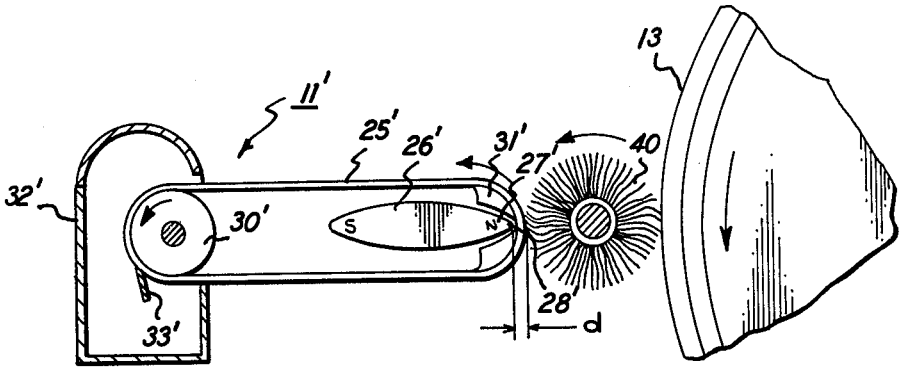
FIG. 3 is a schematic representation of a cleaning apparatus of this invention employed for cleaning a brush cleaning device.
Figure 4:
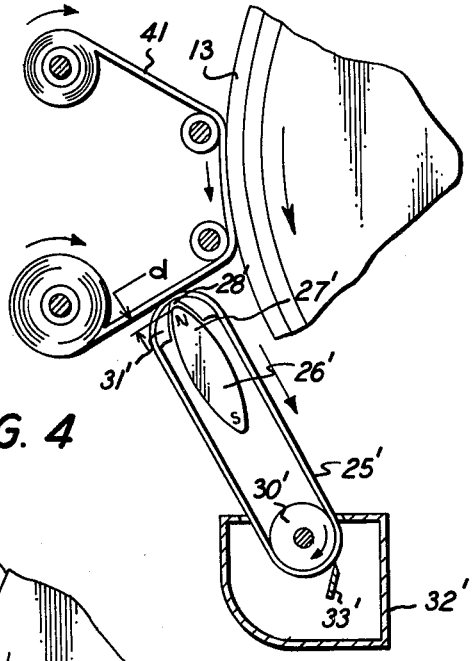
FIG. 4 is a schematic representation of a cleaning apparatus of this invention employed for cleaning a web cleaning device.
Figure 5:
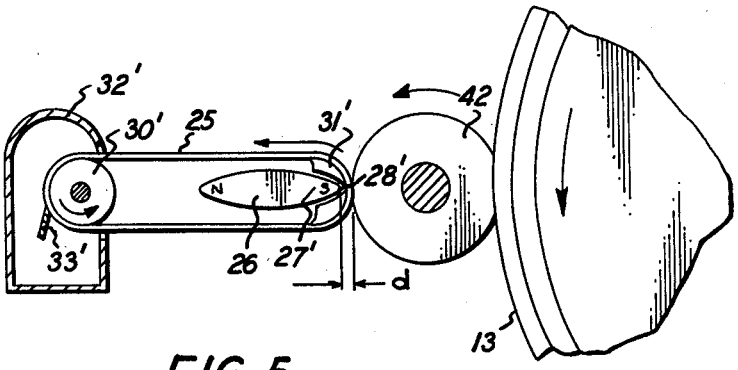
FIG. 5 is a schematic representation of a cleaning apparatus of this invention employed for cleaning a roller cleaning device.

In the embodiment which has just been described, the cleaning system 11 has been utilized to clean directly from an imaging surface 13. In accordance with yet another embodiment of the present invention conventional type cleaning systems 40, 41 and 42 are employed for removing the magnetic toner particles T from the imaging surface. These toner cleaning systems can comprise a brush 40 as shown in FIG. 3, a web 41 as shown in FIG. 4, or a roller 42 as shown in FIG. 5. Details of such conventional systems can be readily obtained from many patents available in the prior art as, for example, U.S. Pat. No. 3,655,373 to Fisher with respect to brush cleaning; U.S. Pat. No. 3,099,856 to Eichorn with respect to web cleaning; and U.S. Pat. No. 3,807,853 to Hudson with respect to roller cleaning. While these three approaches to cleaning are specifically shown, any desired well known cleaning device could be employed.

One of the difficulties associated with any toner cleaning device 40, etc., is the removal of the toner T cleaned from the photoreceptor surface from the cleaning device itself. This is conventionally accomplished in brush cleaning by the use of a vacuum cleaning system and one or more flicker members. In web cleaning a sufficiently long web is generally utilized so that the toner need not be removed from the web or alternatively brushes have been utilized to remove the toner from the web. With respect to roller cleaning systems, it has been conventional to either use brushes or other type devices for removing toner from the roller surface.

It is proposed in accordance with this invention to utilize a magnetic pick-off cleaning system 11' for extracting magnetic toner T from a conventional electrostatographic cleaning apparatus 40, etc. A cleaning apparatus 11' essentially the same as described above by reference to the photoreceptor cleaning system 11 is employed in FIGS. 3, 4, and 5, for removing toner T from a conventional cleaning device 40, etc., by means of magnetic attraction. In each of these systems the cleaning magnet 26' and moving support surface 25' are arranged so as to operate on the brush 40, web 41, or roller 42 for magnetically removing the toner particles from the respective cleaning device by maintaining the gap "*d*" and longitudinal width of the magnetic pole within the aforenoted limits. The parameters and shape of the cleaning magnet 26' are essentially the same as those described by reference to the embodiment of FIG. 2 for the magnet 26. Like elements in FIGS. 3, 4, and 5, have been labled with the like primed numbers of the corresponding elements of FIG. 2.

Therefore, it is apparent that the magnetic cleaning apparatus 11 or 11' of the present invention is well adapted to be utilized for removing magnetic toner T either from an imaging surface 13 directly or from a conventional toner cleaning device 40, etc., respectively. In practice the moving transport surface 25 can be arranged to either engage the surface or device to be cleaned as in FIG. 1 or be slightly spaced therefrom as in FIG. 2. The latter approach is highly desirable for photoconductive surfaces 13 which are subject to wear or abrasion.

If the support surface 25 engages the imaging surface 13 or device 40, etc., to be cleaned then a frictional or mechanical cleaning action is provided in addition to the magnetic attraction described above. When the support surface 25 is in engagement with the imaging surface 13, it is preferred that it move at the same velocity as the velocity of the imaging surface much in the manner of the seal roll in U.S. Pat. No. 3,742,551 to Oriel. Where it is spaced from the imaging surface it may move at any desired speed as exemplified by the seal roll shown in the above-noted patent to Sullivan.

If the transport surface 25 engages the imaging surface 13, it may be desirable to further enhance the mechanical cleaning action by providing a roughened surface 25 or a brush-like or flocked surface. If a flocked or brush surface were employed it might be more desirable to use a brush rather than a blade 33 for removing toner from the belt at the sump.

For either embodiment the gap between the edge 28 or 28' of the magnetic pole 27 or 27' and the imaging surface 13 or cleaning device 40, 41, or 42 should be maintained within the aforenoted gap and ratio limits.

It is also possible in accordance with this invention to provide an electrical potential bias on the cleaning support surface 25 to further aid in removing particles. The approaches as described in the above-noted Fisher and Sullivan patents could be employed to provide such a biased pick-off arrangement.

One of the unique aspects of the magnet arrangement 26 as shown is that the magnetic field and associated field gradient are strongest in the cleaning zone adjacent the imaging surface or cleaning device and gradually decrease as the toner is transported to the sump in order to allow ready removal of the toner from the transport surface 25.

The patents, applications, and texts referred to specifically in this application are intended to be incorporated by reference into the application.

It is apparent that there has been provided in accordance with this invention a cleaning apparatus and electrostatographic reproducing machine which fully satisfies the objects, means and advantages set forth hereinbefore. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. A cleaning apparatus for an electrostatographic reproducing machine for removing magnetic toner from an imaging surface of said machine, said cleaning apparatus comprising:

means for generating an inhomogeneous magnetic field at said imaging surface comprising;

a magnetic member having at least one magnetic pole arranged in close proximity to said imaging surface with an edge of said member at said pole opposing said imaging surface and being spaced from said imaging surface so as to define a gap extending from said imaging surface to said edge of from about 0.005 inches to about 0.050 inches;

means for receiving said magnetic toner particles removed from said imaging surface and for transporting them away from said imaging surface comprising a transport surface, said transport surface being interposed between said magnetic member and said imaging surface;

said transport surface and said imaging surface being arranged for relative movement with respect to one another; and the ratio of the longitudinal width of said edge of said magnetic member, as measured in the direction of relative movement, to said gap, comprising from about 0.5 to about 2.

2. An apparatus as in claim 1, wherein said magnetic member has an eliptical cross-section

3. An apparatus as in claim 1, wherein said gap is from about 0.005 inches, and wherein said ratio comprises from about 0.5 to about 1.

4. An apparatus as in claim 1, wherein said magnetic field generating means creates a magnetic field which decreases as said particles are carried further away from said gap.

5. An apparatus as in claim 1, wherein said transport surface comprises the surface of a belt member and further including storage means in communication with said belt member for receiving said magnetic toner from said belt member.

6. An apparatus as in claim 1, wherein said transport surface comprises a non-magnetic material.

7. An apparatus as in claim 6, wherein said transport surface is non-conductive.

8. An apparatus as in claim 7, wherein said transport surface comprises a roughened surface.

9. An apparatus as in claim 7, wherein said transport surface comprises a brush-like surface.

10. An apparatus as in claim 7, wherein said transport surface comprises a flocked surface.

11. An apparatus as in claim 7, wherein said electrostatographic reproducing machine includes; means for forming an electrostatic image on said imaging surface; means for developing said electrostatic image with magnetic toner to render it visible; and means for transferring said visible magnetic toner image to a sheet of final support material.

12. An apparatus as in claim 1, wherein said transport surface is spaced from said imaging surface.

13. An apparatus as in claim 1, wherein said transport surface engages said imaging surface, and wherein the velocity of said transport surface is substantially the same as the velocity of said imaging surface.

14. A cleaning apparatus for an electrostatographic reproducing machine for removing magnetic toner from an imaging surface of said machine, said cleaning apparatus comprising, first means for removing said magnetic toner from said imaging surface and second means for removing said magnetic toner from said first removing means, the improvement wherein said second means for removing said toner from said first removing means comprises:

means for generating an inhomogeneous magnetic field at said first removing means, comprising a magnetic member having at least one magnetic pole arranged in close proximity to said first removing means, with an edge of said magnetic member at said pole opposing said first removing means and being spaced from said first removing means so as to define a gap extending from said first removing means to said edge of from about 0.005 inches to about 0.050 inches;

means for receiving said magnetic toner particles removed from said first removing means and for transporting them away from said first removing means, comprising, a transport surface, said transport surface being interposed between said magnetic member and said first removing means;

said transport surface and said first removing means being arranged for relative movement with respect to one another; and the ratio of the longitudinal width of said edge of said magnetic member, as measured in the direction of relative movement, to said gap, comprising from about 0.5 to about 2.

15. An apparatus as in claim 14, wherein said magnetic member has an eliptical cross-section.

16. An apparatus as in claim 14, wherein said gap is from about 0.005 inches to about 0.015 inches, and wherein said ratio comprises from about 0.5 to about 1.

17. An apparatus as in claim 14, wherein said magnetic field generating means creates a magnetic field which decreases as said particles are carried further away from said gap.

18. An apparatus as in claim 14, wherein said transport surface comprises the surface of a belt member and further including storage means in communication with said belt member for receiving said magnetic toner from said belt member.

19. An apparatus as in claim 18, wherein said transport surface comprises a roughened surface.

20. An apparatus as in claim 18, wherein said transport surface comprises a brush-like surface.

21. An apparatus as in claim 18, wherein said transport surface comprises a flocked surface.

22. An apparatus as in claim 18, wherein said electrostatographic reproducing machine includes; means for forming an electrostatic image on said imaging surface; means for developing said electrostatic image with magnetic toner to render it visible; and means for transferring said visible magnetic toner image to a sheet of final support material.

23. An apparatus as in claim 14, wherein said transport surface comprises a non-magnetic material.

24. An apparatus as in claim 23, wherein said transport surface is non-conductive.

25. An apparatus as in claim 14, wherein said transport surface is spaced from said first removing means.

26. An apparatus as in claim 14, wherein said transport surface engages said first removing means, and wherein the velocity of said transport surface is substantially the same as the velocity of said imaging surface.

* * * * *